United States Patent [19]

Heslin

[11] 4,325,001

[45] Apr. 13, 1982

[54] INORGANIC SPARK CHAMBER FRAME AND METHOD OF MAKING THE SAME

[75] Inventor: Thomas M. Heslin, New Carrollton, Md.

[73] Assignee: The United States of America as represented by the Administrator of the National Aeronautics and Space Administration, Washington, D.C.

[21] Appl. No.: 128,229

[22] Filed: Mar. 7, 1980

[51] Int. Cl.[3] ..... H01J 1/46; H01J 17/04; H01J 19/38; H01J 19/40

[52] U.S. Cl. ..... 313/348; 250/385; 250/386; 250/389; 313/93; 29/25.14

[58] Field of Search ..... 250/385, 386, 387, 389; 313/348, 93; 29/25.14

[56] References Cited

U.S. PATENT DOCUMENTS

| | | | |
|---|---|---|---|
| 3,772,521 | 11/1973 | Perez-Mendez | 250/385 |
| 3,911,279 | 10/1975 | Gilland et al. | 250/385 |
| 4,193,000 | 3/1980 | Shirayama et al. | 250/385 |
| 4,264,816 | 4/1981 | Walenta | 250/385 |

OTHER PUBLICATIONS

"A Multiwire Proportional Chamber System for Use in a Storage Ring Experiment", by Rand et al, Nuclear Instruments and Method 118, No. 1 (1974) 189–202.

"A Multiwire Proportional Chamber System for Monitoring the Position and Profile of a Charged Particle Beam", by Hargrove et al, Nuclear Instruments and Method 113, No. 1 (1973) 141–145.

*Primary Examiner*—Saxfield Chatmon, Jr.

*Attorney, Agent, or Firm*—Robert D. Marchant; John R. Manning; John O. Tresansky

[57] ABSTRACT

A spark chamber frame 8 is manufactured using only inorganic materials. Spark chamber frame 8 includes a plurality of beams 10, 12, 14, and 16 formed from inorganic material, such as ceramic or glass, and are connected together at ends 9 with inorganic bonding material having substantially the same thermal expansion as the beam material. A plurality of wires 18 and 20 formed from an inorganic composition are positioned between opposed beams 10 and 14 and 12 and 16 so that wires 18 and 20 are uniformly spaced and form a grid. A plurality of hold-down straps 22, 23, 24, and 25 are formed of inorganic material such as ceramic or glass having substantially the same chemical and thermal properties as the beam material. Hold-down straps 22, 23, 24, and 25 overlie wires 18 and 20 extending over beams 10, 12, 14, and 16 and are bonded thereto with inorganic bonding material.

20 Claims, 5 Drawing Figures

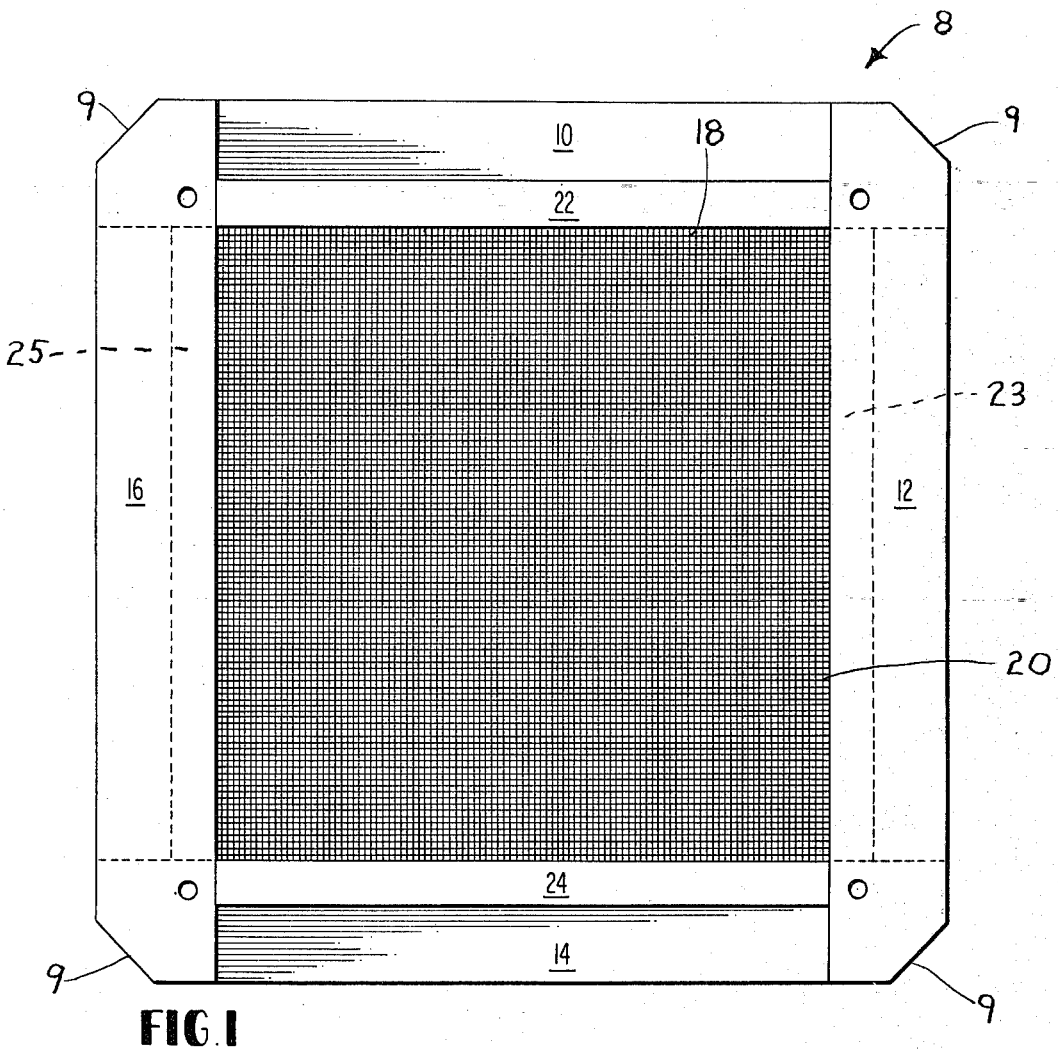
FIG. 1
FIG. 2
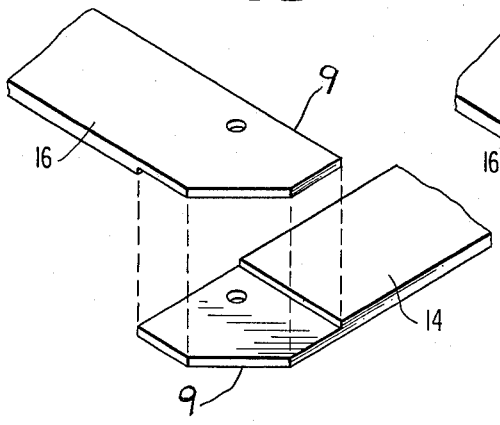
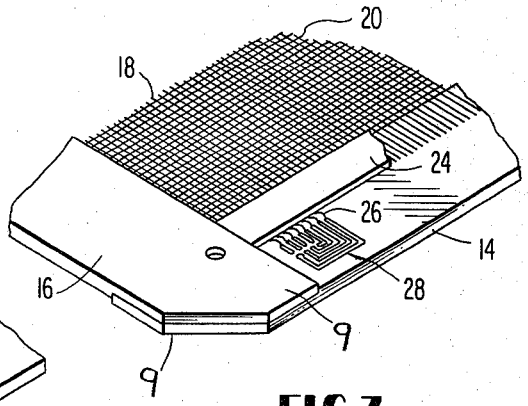
FIG. 3

INORGANIC SPARK CHAMBER FRAME AND METHOD OF MAKING THE SAME

ORIGIN OF THE INVENTION

The invention described herein was made by an employee of the United States Government and may be manufactured and used by or for the Government for governmental purposes without the payment of royalties thereon or therefor.

DESCRIPTION

TECHNICAL FIELD

The invention generally relates to spark chamber frames for detectors that measure gamma radiation, and more particularly to the method of manufacture and structure of completely inorganic spark chamber frames.

Spark chambers are used for measuring the energy and direction of gamma radiation. Typically, a spark chamber may comprise 40 to 50 frames forming a cubic grid at the bottom of which is a scintillation crystal that absorbs the radiation and emits secondary radiation for detection by photomultiplier tubes. Each frame has a square opening which may measure, for example, 81 by 81 cm. with two planes of 992 parallel and evenly spaced wires arranged in two mutually perpendicular directions, the two planes being separated by 4 mm. The wire wound on the frame assembly is made from 0.076 mm. diameter Be-Cu wire stock. The spark chamber is filled with an ionizing gas, and when a high energy photon passes in the vicinity of the cross-points of one of the grids, the locally ionized gas allows an electrical conduction between the two wires forming the cross-point thereby defining the X and Y coordinates of the particle trajectory at that particular frame. The several frames define the Z coordinate in three dimensional space. The ends of each of the wires of each frame are connected to detecting circuits which record coordinates of the trajectory of high energy particles.

BACKGROUND ART

The customary manner of manufacturing spark chambers includes the use of both inorganic and organic materials. Typically, such spark chambers utilize Be-Cu wire and glass-ceramic materials bonded with epoxy materials to form the desired configuration. The printed circuits formed on the spark chamber frames are printed on epoxy fiberglass boards.

One disadvantage of these prior art devices is that by using both inorganic and organic materials the thermal expansion of the materials is different and because these spark chambers are subjected to temperature changes in space and during manufacture, the bonded joints and connections produce cracking and warping. Such cracking and warping causes premature failure and decalibration of the spark chamber frame.

Another disadvantage of such prior art devices is that when used in space experiments they are required to operate in an ionizing gas mixture for relatively long periods of time. By using the conventional organic bonding epoxies and the epoxy fiberglass printed circuit boards outgassing occurs which tends to contaminate the gas reducing spark efficiency and thereby producing inaccurate readings from the associated detectors. To correct this deficiency the gas introduced into the spark chamber must be continuously resupplied to decontaminate the chamber. This requires additional gas to be carried in the spacecraft and once the gas is expended the spark chamber is useless. Thus, these type spark chambers increase the cost and weight of the spacecraft and insure only a limited life which may be too short for many space missions.

Accordingly, one object of the invention is to provide an improved spark chamber frame.

Another object of this invention is to provide a spark chamber frame that maintains substantially the same coefficient of thermal expansion throughout.

Still another object of this invention is to provide a spark chamber frame that is substantially immune to cracking and warping.

A further object of this invention is to provide a spark chamber frame that is relatively simple, light weight, and low in cost.

A still further object of this invention is to provide a spark chamber frame that is substantially immune to outgassing.

Another object of this invention is to provide a spark chamber frame that utilizes only inorganic materials in its manufacture.

A further object of this invention is to provide a spark chamber frame and integral printed circuitry that is completely manufactured from inorganic materials.

A still further object of this invention is to provide a method of manufacturing a spark chamber frame.

Another object of the invention is to provide a method of manufacturing an all inorganic spark chamber frame that will not crack or warp during the manufacturing process.

STATEMENT OF INVENTION

Briefly, these and other objects are obtained by a spark chamber frame with a plurality of beams formed from inorganic materials, such as ceramic or glass, and coupled together at the ends with inorganic bonding material having substantially the same thermal expansion as the beam material. A plurality of wires formed from an inorganic composition are coupled between opposed beams so that the wires are uniformly spaced and form a grid. A plurality of hold-down straps formed of inorganic material, such as ceramic or glass, and having substantially the same chemical and thermal properties as the beam material overlie the wires and the beams and are bonded thereto with inorganic bonding material.

Other objects, features and advantages of the invention will be apparent from the following detailed description of the invention taken in conjunction with the accompanying drawings.

BRIEF DESCRIPTION OF DRAWINGS

In the drawings like parts are designated by the same references in the figures, wherein:

FIG. 1 is a plan view of an inorganic spark chamber frame according to the invention.

FIG. 2 is an exploded view of the end coupling of adjacent beams of FIG. 1.

FIG. 3 is a perspective view of the corner assembly of FIG. 1 showing the wires and hold-down straps.

DETAILED DESCRIPTION OF THE INVENTION

Figure 4:
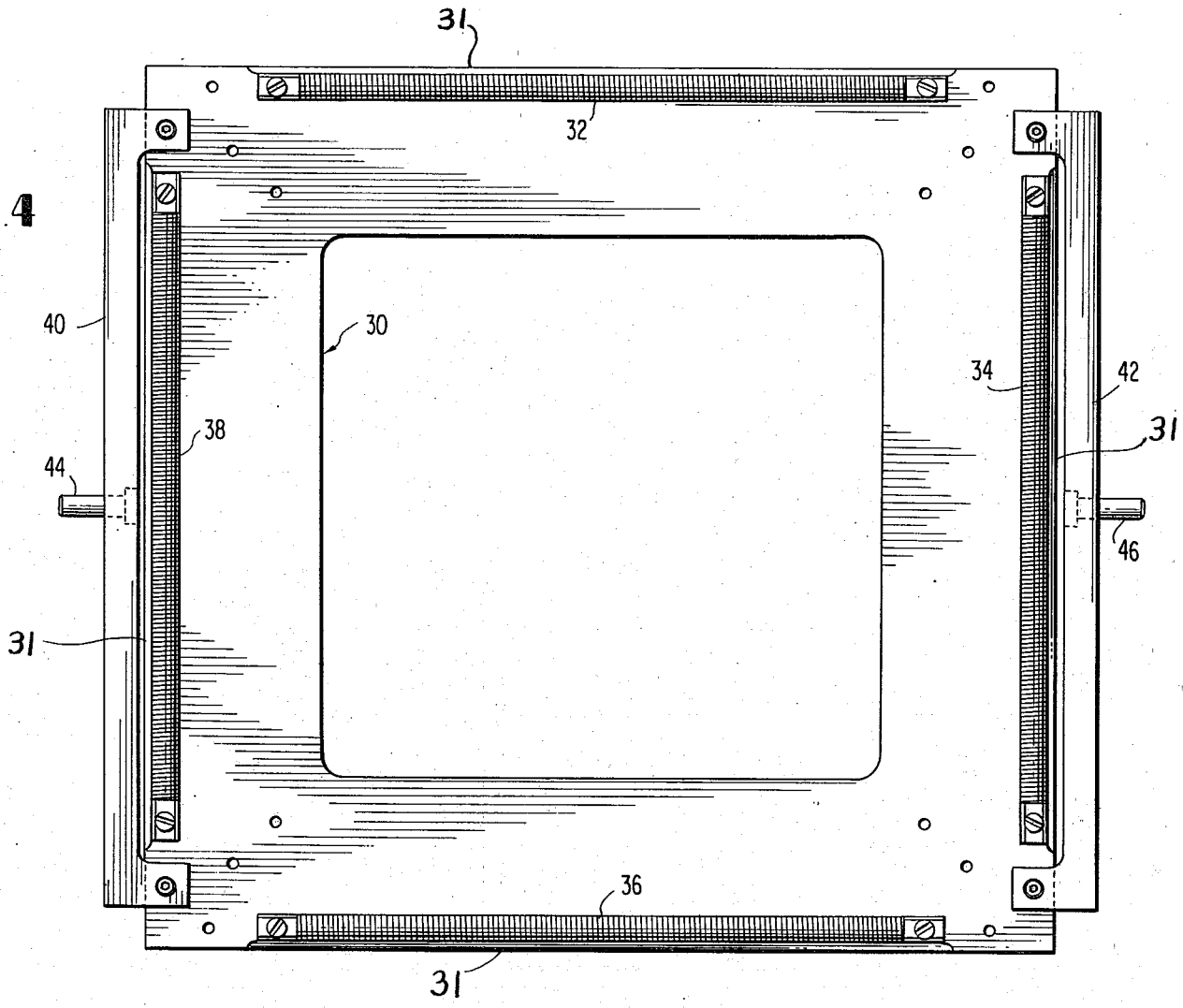
FIG. 4 is a plan view of the wrapping and firing jig used in the manufacturing of the inorganic spark chamber frame.

Referring to FIGS. 1–3, the inorganic spark chamber frame, generally designated by the numeral 8, includes a plurality of beams 10, 12, 14, and 16 formed from inorganic material and coupled together at ends 9 with inorganic bonding material having substantially the same thermal expansion as the beam material. A plurality of wires 18 and 20 formed from an inorganic composition are coupled between opposed beams 10 and 14 and 12 and 16, respectively. Wires 18 and 20 are uniformly spaced to form a grid. A plurality of hold-down straps 22, 23, 24, and 25 are formed from inorganic material having substantially the same chemical and thermal properties as the beam material. The hold-down straps overlie the wires and beams and are bonded thereto with inorganic bonding material.

Referring to FIG. 4, a wrapping/firing jig, generally designated by numeral 30, is shown for assembling spark chamber frame 8. Wire combs 32, 34, 36, and 38 are secured to each of the four edges 31 of the jig. Opposed wire combs 32 and 36 cooperate to properly align wires 18 and opposed wire combs 34 and 38 cooperate to properly align wires 20. Yoke assemblies 40 and 42 are secured to opposite edges 31 and are provided with an axle 44 and 46, respectively. The axles are aligned to define a common axis about which the jig is rotated for the purpose of wrapping wire thereabout, as will be explained. The yoke assemblies are removable so that th jig can be rotated 90 degrees in the plane of the figure so that wires 18 and 20 can be wrapped perpendicular to each other. The wrapping/firing jig is preferably made from inorganic material which does not extensively oxidize and has a coefficient of linear thermal expansion which is slightly larger than that of the inorganic spark chamber frame to maintain the tautness of the wire during the bonding process. Preferably, the jig is greater than 1.25 centimeters thick and annealed prior to final machining to avoid any warpage during heating. The preferred composition of the jig material to make it compatible with the inorganic spark chamber frame is 54–58 percent Ni, 19–23 percent Cr, 13–14 percent Co, 8–10 percent Mo, and 0–1 percent Al, Ti, and Fe.

Referring again to FIGS. 1–4, beams 10, 12, 14, and 16 are formed out of any inorganic material such as ceramic or glass. By using ceramic or glass the outgassing rates are kept below the preferred level of $10^{12}$ pascal-liter/second. Two materials which may be used to maintain this outgassing level are glass-bonded mica and a devitrified glass with a mica composition. Ends 9 of each of the beams are rabbeted, as illustrated in FIG. 2, to allow the ends of adjacent beams to overlap for proper bonding. The depth of the rabbet will determine the axial spacing between the vertical wires 18 and the horizontal wires 20.

The bonding of adjacent ends 9 and the bonding of wires 18 and 20 to beams 10, 12, 14, and 16 requires at least a two step firing operation unless all the components are fired in place at the same time. First, the ends of the beams are bonded and then hold-down straps 22, 23, 24, and 25 and the wires are bonded. This requires that the bonding adhesive used for the end bonding will not be soft while the hold-down straps and wires are being bonded in place. This is accomplished by either a high-low or a low-low temperature bonding approach.

In the high-low temperature bonding approach, a vitreous thermoplastic glass adhesive is used to bond the beam ends together. This glass has a high melting range of between substantially 700 degrees centigrade and 1000 degrees centigrade. The hold-down straps and wires are subsequently bonded using a lower temperature glass which may be either a vitreous thermoplastic or a devitrifying thermosetting glass adhesive. The bonding temperatures of these lower temperature glasses must be in the annealing range of the end bonding glass which is typically about 350 degrees centigrade to 650 degrees centigrade. The vitreous thermoplastic glass used for bonding the ends of the beams together is taken from the systems $SiO_2$-$Na_2O$-(CaO,MgO)-$Al_2O_3$ or $SiO_2$-PbO-($Na_2O$,$K_2O$)-CaO-$Al_2O_3$. These systems are set out in Tables I and II below:

TABLE I

| | |
|---|---|
| | Melting range about 850 degrees centigrade to 1000 degrees centigrade |
| | Coefficient of linear thermal expansion between about 9 and $10.5 \times 10^{-6}$ per degree centigrade |
| $SiO_2$ | about 72–74 percent |
| $Na_2O$ | about 17–18 percent |
| CaO, MgO | about 9–10 percent |
| $Al_2O_3$ | about 0–1 percent |

TABLE II

| | |
|---|---|
| | Melting range about 850 degrees centigrade to 1000 degrees centigrade |
| | Coefficient of linear thermal expansion between about 9 and $10.5 \times 10^{-6}$ per degree centigrade |
| $SiO_2$ | about 57–63 percent |
| PbO | about 20–30 percent |
| $Na_2O$, $K_2O$ | about 11–14 percent |
| CaO | about .4–1 percent |
| $Al_2O_3$ | about .3–1.5 percent |

In the low-low temperature bonding approach, a devitrifying thermosetting glass adhesive is used for the end bonding while either a devitrifying thermosetting glass or a vitreous thermoplastic glass is used for the hold-down strap and wire bonding operation. The devitrifying thermosetting glass becomes refractory at its melting-crystallization temperature and a joint made therewith can, therefore, be reheated to its bonding temperature without distortion. The only requirement when using this bonding approach is that the hold-down strap and wire bonding temperature be less than, or equal to, the end bonding temperature. The devitrifying thermosetting glass adhesive is taken from the system PbO-$B_2O_3$-ZnO-$SiO_2$ with small additions of $Al_2O_3$, CuO, or $TiO_2$. This system is set forth in Table III below:

TABLE III

| | |
|---|---|
| | melting-crystallization range from about 365 degrees centigrade to 550 degrees centigrade |
| | Coefficient of linear thermal expansion between about 9 and $10.5 \times 10^{-6}$ per degree centigrade |
| PbO | about 70–80 percent |
| $B_2O_3$ | about 3–15 percent |
| ZnO | about 7–14 percent |
| $SiO_2$ | about .5–3 percent |

TABLE III-continued

| | |
|---|---|
| $Al_2O_3$, CuO, $TiO_2$ | about 1–2 percent |

In the low-low temperature approach, the hold-down strap and wire bonding glass is either a devitrifying thermosetting glass adhesive, as used in the end bonding, or it may be a stable vitreous thermoplastic glass taken from the system $PbO$-$B_2O_3$-$ZnO$-$SiO_2$ with small additions of $Al_2O_3$. This system is set forth in Table IV below:

TABLE IV

| | |
|---|---|
| Melting range from about 400 degrees centigrade to 550 degrees centigrade | |
| Coefficient of linear thermal expansion between about 9 and $10.5 \times 10^{-6}$ per degree centigrade | |
| PbO | about 70–85 percent |
| $B_2O_3$ | about 10–25 percent |
| ZnO | about 1–17 percent |
| $SiO_2$ | about 1–5 percent |
| $Al_2O_3$ | about .2–2.5 percent |

The glass adhesives in the low-low temperature approach will be compatible with the beam and hold-down strap inorganic material both chemically and thermally. Thus, cracking and warping due to differences in coefficients of thermal expansion will not occur and outgassing is minimized.

In the high-low temperature approach, hold-down straps and wire bonding glass is selected from one of the two types described in tables III and IV which are also used in the low-low temperature bonding approach. Thus, because these adhesives are compatible with the beam and hold-down strap inorganic material, cracking and warping caused by a difference in the coefficients of thermal expansion will be prevented and outgassing will be minimized.

Any of the adhesives in the high-low or low-low temperature approaches may be applied by making a paint and then spraying, brushing, screen printing, or doctor blading the paint into place. The paint is made in any conventional manner, such as by grinding the appropriate glass adhesive into a powder having a screen mesh of from 100 to 200. The powder is then ground together with a suspension vehicle. The suspension vehicle is preferably a 1 to 4 percent by weight solution of nitrocellulouse in amylacetate, however; distilled water with a few drops of aqueous sodium silicate may also be used. Although the suspension vehicle approach is preferred, the glass paint may also be slip cast into a sheet and applied as a thin film. If the melting range of the glass lies above 550 degrees centigrade, a transfer adhesive may be applied to one side of the slip cast sheet to make a glass tape. These methods of adhesive application will ensure uniformity of thickness and reproducibility of bond integrity.

After the formation of the beams from the inorganic material and the ends have been properly rabbeted, a printed metalization circuit 28, as shown in FIG. 3, is formed on each of the beams. The printed circuits are applied directly on each of the beams by screen printing silver paste onto the beams and then firing the silver in place. The composition of the silver paste is preferably about 60–80 percent silver with about 20–40 percent of a glass adhesive. The composition of the glass adhesive may be of the type described in Tables I, II, and IV so that the printed circuit is chemically and thermally compatible with the beam material. The silver and glass adhesive is suspended within a suspension vehicle of about 1 to 4 percent by weight of nitrocellulous in an amylacetate solution or a pine oil and ethyl cellulous solution may be used. If a two fire operation is used it is preferred that the firing of the printed circuits be accomplished at the same time the first fire operation is conducted for bonding the ends of the beams.

Following the formation of beams 10, 12, 14, and 16 and printed metalization circuits 28 on each of the beams, the desired end bonding glass adhesive chosen from the compositions in Tables I, II, or III is applied in the manner previously described to each of the ends of the beams. The frame 8 is then formed on wrapping/firing jig 30 and secured thereto in any conventional manner such as by bolts (not shown) so that the ends of adjacent beams overlap. The jig and assembled beams are then fired in a conventional firing furnace at the appropriate temperature for the type of end bonding glass adhesive that was used. The firing operation will properly bond ends 9 together and properly bond printed metalization circuit 20 to the beams. Because the end bonding adhesive is compatible with the beam material, the spark chamber frame 8 will not be subjected to cracking, warping, and outgassing.

Figure 5:
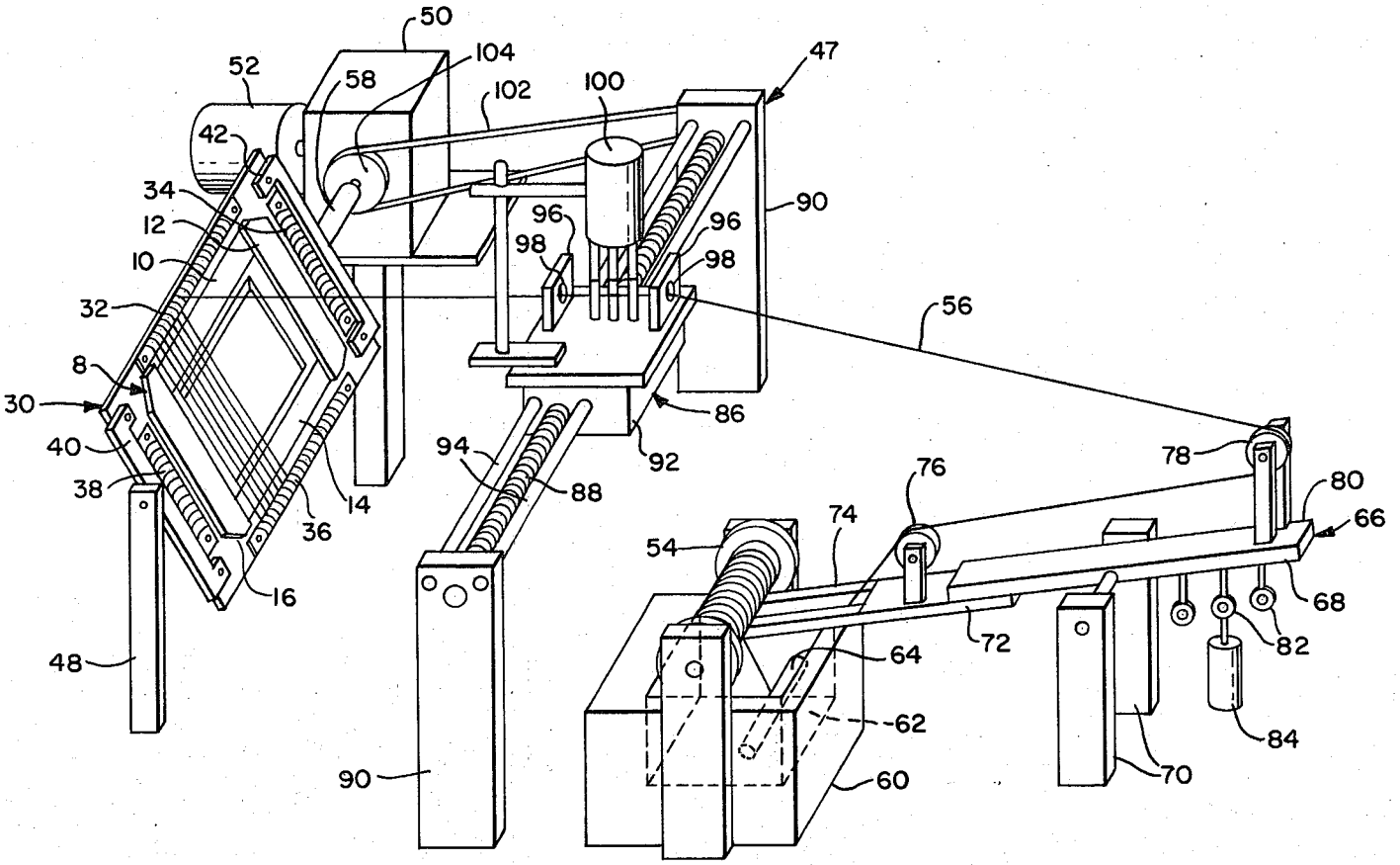
FIG. 5 is a perspective view of the inorganic spark chamber frame and wrapping jig showing the wire cleaning, tensioning and delivery devices.

As shown in FIG. 5, the next step in the formation of spark chamber frame 8 is to wrap a wire 56 between opposed beams 10 and 14 to form vertical wires 18 and between opposed beams 12 and 16 to form horizontal wires 20. Wire 56 is formed from an inorganic composition which is bondable to printed metalized circuits 28 and matches the coefficient of linear thermal expansion of spark chamber frame 8 and bonding adhesives thereby to prevent cracking and warping of the spark chamber frame. In addition, the wire is preferably oxidation resistant and has a tensile strength in excess of 90,000 psi after heating to 500 degrees centigrade in air. A wire with such characteristics has a composition of substantially 70–72 percent Fe, 23–25 percent Cr, 5–6 percent Al, and 0–1 percent Co. In addition, the wire may be electroplated with Au to a thickness in excess of 127 micro centimeters to make the wire more solderable. To insure that the thin Au plating adheres to the printed metalized circuit it is desirable to remove any oxidation by subjecting the wire to an electrolytic etch.

Wire 56 is wrapped utilizing jig 30 and a wire wrapping machine, generally designated by numeral 47. With beams 10, 12, 14, and 16 secured to the jig, yoke assembly 40 is rotatably secured by axle 44 to a vertical post or stanchion 48. Yoke assembly 42 is coupled to a conventional transmission 50 by a coupling device 58. An electric motor 52 is coupled to the transmission and when activated rotates the jig.

To insure proper functioning of the spark chamber frame 8, wire 56 must be properly cleaned, tensioned, and positioned on the spark chamber frame. In cleaning wire 56 any method may be used, however; it is preferred that ultrasonic cleaning be used to ensure removal of all foreign material from the wire. To ultrasonically clean the wire, a spool 54 containing the wire is rotatably supported above a conventional ultrasonic cleaning device 60 containing a tank 62 and a roller 64 inside the tank. The tank is filled with a cleaning solvent such as alcohol and the wire is unrolled from the spool down into the tank of alcohol and around the roller. As the wire is unwound from the spool, the wire is cleaned by the ultrasonic sound waves and by the alcohol so that when the wire leaves the ultrasonic cleaning device it will be properly cleaned of all foreign material.

Wire 56 may be tensioned by any conventional tensioning device, however, an automatically compensating tensioning device, generally designated by numeral 66, is preferred. The tensioning device includes a support 68 which is rotatably secured at substantially its midpoint to a pair of stanchions 70. A drag bar 72 is affixed to one end of the support and includes a forked end 74 which frictionally engages spool 54. A pulley 76 is mounted on the drag bar and another pulley 78 is mounted on end 80 of the support. The wire exits ultrasonic device 60 and extends through forked end 74, over pulley 76, and around pulley 78. A plurality of weight holders 82 are secured to end 80 of the support for hanging an appropriate weight 84 therefrom. By placing the weight on an appropriate weight holder, the support will rotate clockwise causing the forked end of the drag bar to frictionally engage the spool. The more weight applied will cause an increase in friction which will increase the tension on the wire.

Wire 56 may be properly positioned on spark chamber frame 8, by any wire positioning mechanism, however; automatic wire positioning device, generally designated by numeral 86, is preferred. The wire positioning device is composed of a rotatable screw 88 supported at each end by a pair of stanchions 90. A traveling nut platform 92 having matching screw threads engages the screw and is supported thereon from rotating by supports 94. As the screw is turned the platform will travel the length of the screw. A pair of wire guides 96 are disposed on the platform and includes apertures 98 through which the wire extends so that as the platform moves along the screw, the wire will travel with the platform. A conventional tension sensing device 100 is placed on the platform to monitor the amount of tension on the wire. The screw is rotated by coupling the screw to transmission 50 through a chain 102 linked between a sprocket 104 connected to coupling device 58 and another sprocket (not shown) connected to the end of the screw.

In the wire wrapping operation, wire 56 is unrolled from spool 54, around roller 64, over pulley 76, around pulley 78, through apertures 98 in wire guides 96 and is secured to one end of comb 32 on wrapping/firing jig 30. Motor 52 is activated to rotate the jig whereupon the wire is wrapped around the jig forming vertical wires 18. Wires 18 are uniformly spaced by the spacing of the teeth on the combs 32 and 36 and the wire is guided into the proper teeth by wire positioning device 86. As long as the teeth in screw 88 and the sprockets for chain 102 are properly selected, platform 92 will move at the proper velocity to insure that the wire is guided into the proper teeth in combs 32 and 36. The proper tension on the wire is maintained by hanging the proper weight 84 on the proper weight holder 82. The tension for a given weight is self-adjusting because the frictional drag on spool 54 will decrease if the tension on the wire increases and the drag will increase if the tension is decreased.

After wire 56 is completely wrapped around combs 32 and 36, wrapping/firing jig 30 is removed from stanchion 48 and coupling device 58. Yoke assemblies 40 and 42 are removed and rotated 90 degrees and the jig is reconnected to the stanchion and coupling device. The wire is connected to the end of comb 38 and the horizontal wires 20 are wrapped in the same manner as were wires 18.

Referring again to FIGS. 1–4 after wire 56 is wound on wrapping/firing jig 30, the next step is to secure wires 18 and 20 to beams 10, 12, 14, and 16. Hold-down straps 22, 23, 24, and 25 are formed from inorganic material preferably of the same type of glass or ceramic material which form the beams. Thus, the hold-down straps will be chemically and thermally compatible with the beams. A hold-down strap and wire adhesive selected from Tables I, II, or IV is applied as previously described to the wires that overlap each of the beams. The hold-down straps are placed over the adhesive and wires. The jig is then fired in a conventional firing furnace at the appropriate temperature of the bonding adhesive to bond the wires to the beams and hold-down straps.

After the firing operation, the wires 18 and 20 extending beyond the hold-down straps are cut forming pig-tails 26. These pig-tails are attached to each of the printed metalization circuits 28 by any appropriate manner such as soldering. Alternatively, the step of attaching the wires to the printed metalization circuits may be performed simultaneously with the firing of the spark chamber frame 8 to bond the hold-down straps and wires. After the wires are attached, the excess wire is removed.

An inorganic spark chamber frame and a method of making the same has been described. By the sole use of inorganic materials in the manufacture of the spark chamber frame that have substantially the same coefficient of thermal expansion, the spark chamber frame will be substantially immune to cracking, warpage, and outgassing. Because there will be no outgassing, the need for additional gas supplies to decontaminate the ionized gas is eliminated. Obvious modifications and variations of the spark chamber frame are possible in light of the above teachings. It is to be understood, therefore, that within the scope of the appended claims the spark chamber frame may be practiced otherwise than as specifically disclosed.

Accordingly, the invention having been described in its best embodiment and mode of operation, that which is desired to be claimed by Letters Patent is:

1. A method of manufacturing spark chamber frames, comprising the steps of:

forming a plurality of beams from inorganic material;

applying an inorganic bonding material to each end of said beams, said inorganic bonding material having substantially the same thermal expansion as said beam material;

forming said beams in a jig so that said ends of adjacent beams overlap;

firing said beams and said jig to bond said overlapping ends of said beams;

wrapping a wire between opposed beams, said wires being formed from an inorganic composition and uniformly spaced forming a grid;

covering said wires on said beams with an inorganic bonding material, said inorganic bonding material being substantially chemically and thermally compatible with said beam material;

covering said inorganic bonding material and said wires with a plurality of hold-down straps formed from inorganic material; and firing said hold-down straps and said jig for bonding said wires to said beams.

2. The method of claim 1 wherein said inorganic material is ceramic.

3. The method of claim 1 wherein said inorganic material is glass.

4. The method of claim 1 wherein said step of wrapping includes the steps of:

cleaning said wires;

uniformly tensioning said cleaned wire; and delivering said uniformly tensioned wire between said opposed beams so that adjacent wires of said grid are uniformly spaced.

5. The method of claim 1 further including the step of applying a metalization circuit to each of said beams following said step of forming, said metalization circuit being fired simultaneously with said step of firing said beams to bond said ends.

6. The method of claim 5 further including the step of attaching ends of said wires extending beyond said bonds on said beams to said metalization circuits.

7. The method of claim 6 wherein said step of attaching said ends is performed simultaneously with said step of firing said beams to bond said wires to said beams.

8. A spark chamber frame, comprising:

a plurality of beams formed of inorganic material;

a first inorganic bonding material having substantially the same coefficient of thermal expansion as said beam material coupling the ends of said beams together;

a plurality of wires formed from an inorganic alloy and coupled between opposed beams, said wires being uniformly spaced and forming a grid;

a plurality of hold-down straps formed of inorganic material and having substantially the same chemical and thermal properties as said beam material, said hold-down straps overlying said wires and said beams; and a second inorganic bonding material joining said hold-down straps, said wires and said beams.

9. The spark chamber of claim 8 wherein said inorganic material is ceramic.

10. The spark chamber frame of claim 8 wherein said inorganic material is glass.

11. The spark chamber frame of claim 8 wherein said inorganic bonding material for bonding said ends of said beams together is a stable vitreous thermoplastic glass.

12. The spark chamber frame of claim 11 wherein said vitreous thermoplastic glass is from the system $SiO_2$-$Na_2O$-($CaO$,$MgO$)-$Al_2O_3$ having the following composition:

$SiO_2$: 72–74 percent $Na_2O$: 17–18 percent $CaO$, $MgO$: 9–10 percent $Al_2O_3$: 0–1 percent 13. The spark chamber frame of claim 11 wherein said vitreous thermoplastic glass is from the system $SiO_2$-$PbO$-($Na_2O$,$K_2O$)-$CaO$-$Al_2O_3$ having the following composition:

$SiO_2$: 57–63 percent $PbO$: 20–30 percent $Na_2O$,$K_2O$: 11–14 percent $CaO$: 0.4–1 percent $Al_2O_3$: 0.3–1.5 percent 14. The spark chamber frame of claim 8 wherein said inorganic bonding material for bonding said ends of said beams together is a devitrifying thermosetting glass.

15. The spark chamber frame of claim 14 wherein said devitrifying thermosetting glass is from the system $PbO$-$B_2O_3$-$ZnO$-$SiO_2$ with small amounts of $Al_2O_3$, $CuO$, or $TiO_2$ having the following composition:

$PbO$: 70–80 percent $B_2O_3$: 3–15 percent $ZnO$: 7–14 percent $SiO_2$: 0.5–3 percent $Al_2O_3$,$CuO$,$TiO_2$: 1–2 percent 16. The spark chamber frame of claim 8 wherein said inorganic bonding material for bonding said hold-down straps and said wires to said beams is a devitrifying thermosetting glass.

17. The spark chamber frame of claim 16 wherein said devitrifying thermosetting glass is from the system $PbO$-$B_2O_3$-$ZnO$-$SiO_2$ with small amounts of $Al_2O_3$, $CuO$, or $TiO_2$ having the following composition:

$PbO$: 70–80 percent $B_2O_3$: 3–15 percent $ZnO$: 7–14 percent $SiO_2$: 0.5–3 percent $Al_2O_3$,$CuO$,$TiO_2$: 1–2 percent 18. The spark chamber frame of claim 8 wherein said inorganic bonding material for bonding said hold-down straps and said wires to said beams is a stable vitreous thermoplastic glass.

19. The spark chamber frame of claim 18 wherein said stable vitreous thermoplastic glass is taken from the system $PbO$-$B_2O_3$-$ZnO$-$SiO_2$ with small amounts of $Al_2O_3$ having the following composition:

$PbO$: 70–80 percent $B_2O_3$: 10–25 percent $ZnO$: 1–17 percent $SiO_2$: 1–5 percent $Al_2O_3$: 0.2–2.5 percent 20. The spark chamber frame of claim 8 further including metalization circuits formed on said beams, said wires extending beyond said hold-down straps and bonded to said metalization circuits.

* * * * *